US009562354B2

(12) United States Patent
Strassle et al.

(10) Patent No.: US 9,562,354 B2
(45) Date of Patent: Feb. 7, 2017

(54) FRAME PROFILE SYSTEM

(75) Inventors: Marcel Strassle, Kirchberg (CH); Kurt Zullig, Kirchberg SG (CH)

(73) Assignee: SYMA INTERCONTINENTAL AG, Kirchberg (CH)

( * ) Notice: Subject to any disclaimer, the term of this patent is extended or adjusted under 35 U.S.C. 154(b) by 0 days.

(21) Appl. No.: 13/880,535

(22) PCT Filed: Oct. 21, 2011

(86) PCT No.: PCT/EP2011/068383

§ 371 (c)(1),
(2), (4) Date: Apr. 19, 2013

(87) PCT Pub. No.: WO2012/052530

PCT Pub. Date: Apr. 26, 2012

(65) Prior Publication Data

US 2013/0199118 A1 Aug. 8, 2013

(30) Foreign Application Priority Data

Oct. 22, 2010 (EP) ..... 10188542

(51) Int. Cl.
*E04C 2/38* (2006.01)
*E04B 2/74* (2006.01)

(52) U.S. Cl.
CPC ..... *E04C 2/38* (2013.01); *E04B 2/7425* (2013.01); *E04B 2002/7462* (2013.01); *E04B 2002/7472* (2013.01); *E04B 2002/7474* (2013.01)

(58) Field of Classification Search
CPC ..... E04B 2/7425; E04B 2002/7462; E04B 2002/7472; E04B 2002/7474; E04C 2/38
USPC ..... 52/489.1, 489.2, 481.2, 476, 235, 243, 52/582.2, 584.1
See application file for complete search history.

(56) References Cited

U.S. PATENT DOCUMENTS 2,101,001 A * 11/1937 Balduf ..... 52/506.09
3,852,927 A * 12/1974 Birum, Jr. ..... 52/241
4,271,566 A * 6/1981 Perina ..... 24/442
5,408,796 A * 4/1995 Hashimoto et al. ..... 52/489.2
5,644,878 A * 7/1997 Wehrmann ..... 52/287.1
5,881,518 A * 3/1999 Edwards ..... E04B 2/7425 160/135

(Continued)

FOREIGN PATENT DOCUMENTS

CH 686 966 A5 8/1996
DE 20 2006 015799 U1 12/2006

OTHER PUBLICATIONS

International Search Report of PCT/EP2011/068383 dated Jan. 25, 2012.

*Primary Examiner* — Brent W Herring
(74) *Attorney, Agent, or Firm* — Sughrue Mion, PLLC

(57) ABSTRACT

The invention relates to a system which is used to provide a planar structure, such as a wall or a ceiling, comprising a profiled frame (1) which is assembled from a plurality of profiled elements (2, 7), and a flexible or rigid, flat planar element (3) extending at least partially over said profiled frame (1). The planar element (3) is detachably connected to a connecting element (4, 8) by means of a form fit and/or a force closure. The connecting element (4, 8) is detachably connected to the profiled frame (1) by means of a form fit and/or a force closure, so that the planar element (3) is indirectly connected to the profiled frame (1) by means of the connecting element (4, 8), and wherein the connecting element (4, 8) is separate from the profiled frame (1) and the planar element (3).

11 Claims, 8 Drawing Sheets

(56) References Cited

U.S. PATENT DOCUMENTS

| | | | | |
|---|---|---|---|---|
| 5,899,035 | A * | 5/1999 | Waalkes | E04B 2/7433 211/192 |
| 6,397,533 | B1 * | 6/2002 | Hornberger | A47B 95/008 52/238.1 |
| 6,446,396 | B1 * | 9/2002 | Marangoni | A47B 96/027 108/50.02 |
| 6,612,077 | B2 * | 9/2003 | Parshad | 52/36.5 |
| 6,729,085 | B2 * | 5/2004 | Newhouse | B25B 5/003 52/239 |
| 6,928,776 | B2 * | 8/2005 | Hornung | 52/204.62 |
| 6,968,661 | B2 * | 11/2005 | Kopish et al. | 52/489.1 |
| 7,661,237 | B2 * | 2/2010 | Jakob-Bamberg et al. | 52/506.08 |
| 7,971,404 | B2 * | 7/2011 | Timko | E04F 13/0816 403/291 |
| 8,065,846 | B2 * | 11/2011 | McDonald et al. | 52/281 |
| 8,096,089 | B2 * | 1/2012 | Platt | 52/316 |
| 8,523,149 | B1 * | 9/2013 | Novak | 256/23 |
| 8,534,021 | B2 * | 9/2013 | Liu et al. | 52/481.2 |
| 8,596,007 | B2 * | 12/2013 | Hibbs | E04B 2/7457 248/317 |
| 8,707,648 | B2 * | 4/2014 | Timko et al. | 52/511 |
| 2002/0002805 | A1 * | 1/2002 | Yamaguchi | E04B 2/7457 52/396.05 |
| 2002/0112435 | A1 * | 8/2002 | Hartman | E04B 7/024 52/648.1 |
| 2007/0011969 | A1 | 1/2007 | Little, Jr. | |
| 2008/0134610 | A1 | 6/2008 | Jakob-Bamberg et al. | |
| 2009/0277117 | A1 * | 11/2009 | Platt | E04B 9/0414 52/316 |
| 2013/0111840 | A1 * | 5/2013 | Bordener | 52/393 |

* cited by examiner

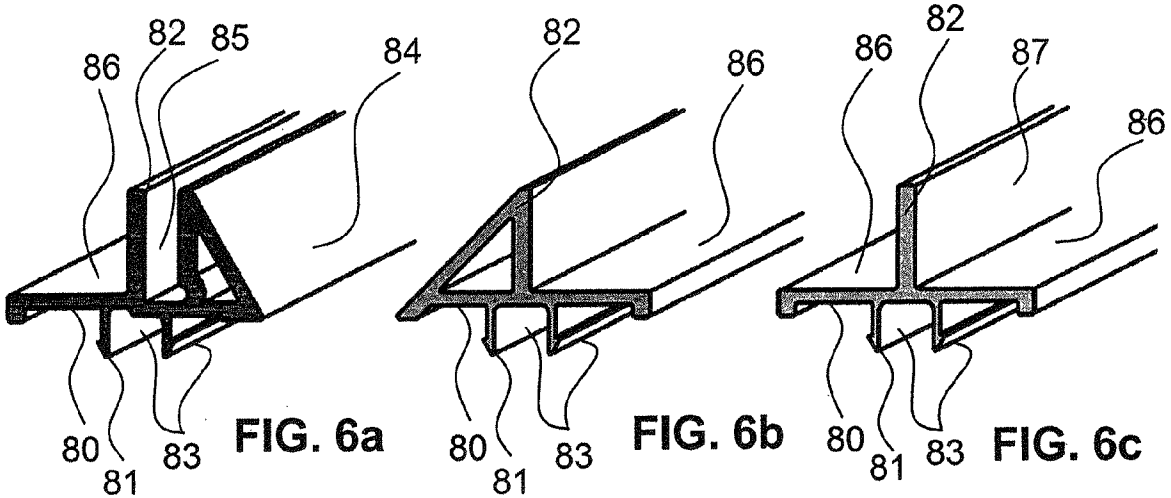
FIG. 6a
FIG. 6b
FIG. 6c
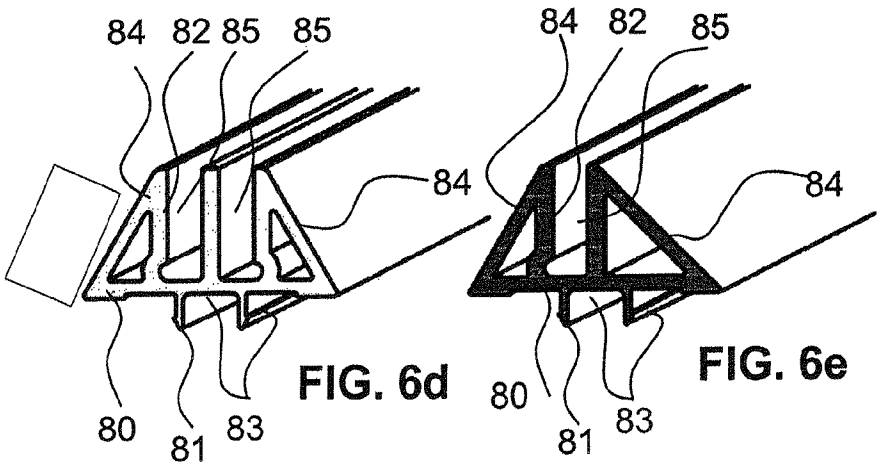
FIG. 6d
FIG. 6e

FRAME PROFILE SYSTEM

TECHNICAL FIELD

The present invention relates to a system which is used to provide a planar structure, such as a wall or a ceiling, according to the preamble of claim 1.

PRIOR ART

Frame systems which are used to provide walls or ceilings are known from the prior art. Such systems typically comprise a peripheral frame comprising frame profiles connected to one another and a wall element which is inserted into the frame. The wall element is connected to the frame element in the inserted state.

With the systems known from the prior art, there is the drawback that use is usually made of profiles which are suitable solely for this purpose, since the profiles comprise corresponding connecting means, such as for example specially formed profile webs. Many users, in particular in the area of fair construction, would however like to have systems which are capable of being used in a modular manner and which permit a large number of applications.

DESCRIPTION OF THE INVENTION

Proceeding from this prior art, the invention is based on a problem of specifying a system which is used to provide a planar structure, wherein the system is intended to overcome the drawbacks of the prior art. In particular, the system should be able to be used in a modular manner for various intended purposes.

Such a problem is solved by the features of claim 1. Accordingly, a system is used to provide a planar structure, such as a wall or a ceiling, comprising a profiled frame assembled from a plurality of profiled elements and a flexible or rigid flat planar element extending at least partially over this profiled frame. The planar element is connected detachably to a connecting element in a form-fit and/or force-fit closure. The connecting element is detachably connected to the profiled frame by means of a form-fit and/or force-fit closure, so that the planar element is indirectly connected to the profiled frame by means of the connecting element, and wherein the connecting element is separate from the profiled frame and the planar element.

The connecting element is preferably connected to the profiled frame by means of a snap-in connection, wherein the connecting element comprises snap-in elements which extend from the connecting element from the side facing the profiled frame. The connecting element can thus be assembled in a particularly straightforward manner.

The connecting element essentially extends over the same length as the profiled element to which the connecting element is connected. A good connection between the profiled frame or profiled element and the connecting element can thus be achieved.

In particular, the connecting element comprises a first textile closure element on the side facing the planar element, and the planar element comprises a second textile closure element adhering to the first textile closure element, so that the planar element can be connected to the connecting element by means of the textile closure elements.

The planar element preferably has a flexible structure with an edge region, and the connecting element provides an intermediate space which accommodates the edge region of the flexible structure in an essentially force-fit manner, so that the flexible structure can be clamped over the profiled frame.

The planar element is preferably surrounded at the edge completely or in sections around the periphery with an edge reinforcement element, wherein the edge reinforcement element can be introduced into the intermediate space and can be clamped there in a force-fit manner.

Further embodiments are given in the dependent claims.

BRIEF DESCRIPTION OF THE DRAWINGS

Preferred embodiments of the invention are described below with the aid of the drawings, which serve merely for explanation and are not to be interpreted as being limiting. In the drawings:

FIG. 6*a*-6*e* show diagrammatic representations of connecting elements, which can be used in particular in the third and the further embodiments;

DESCRIPTION OF PREFERRED EMBODIMENTS

Figure 1:
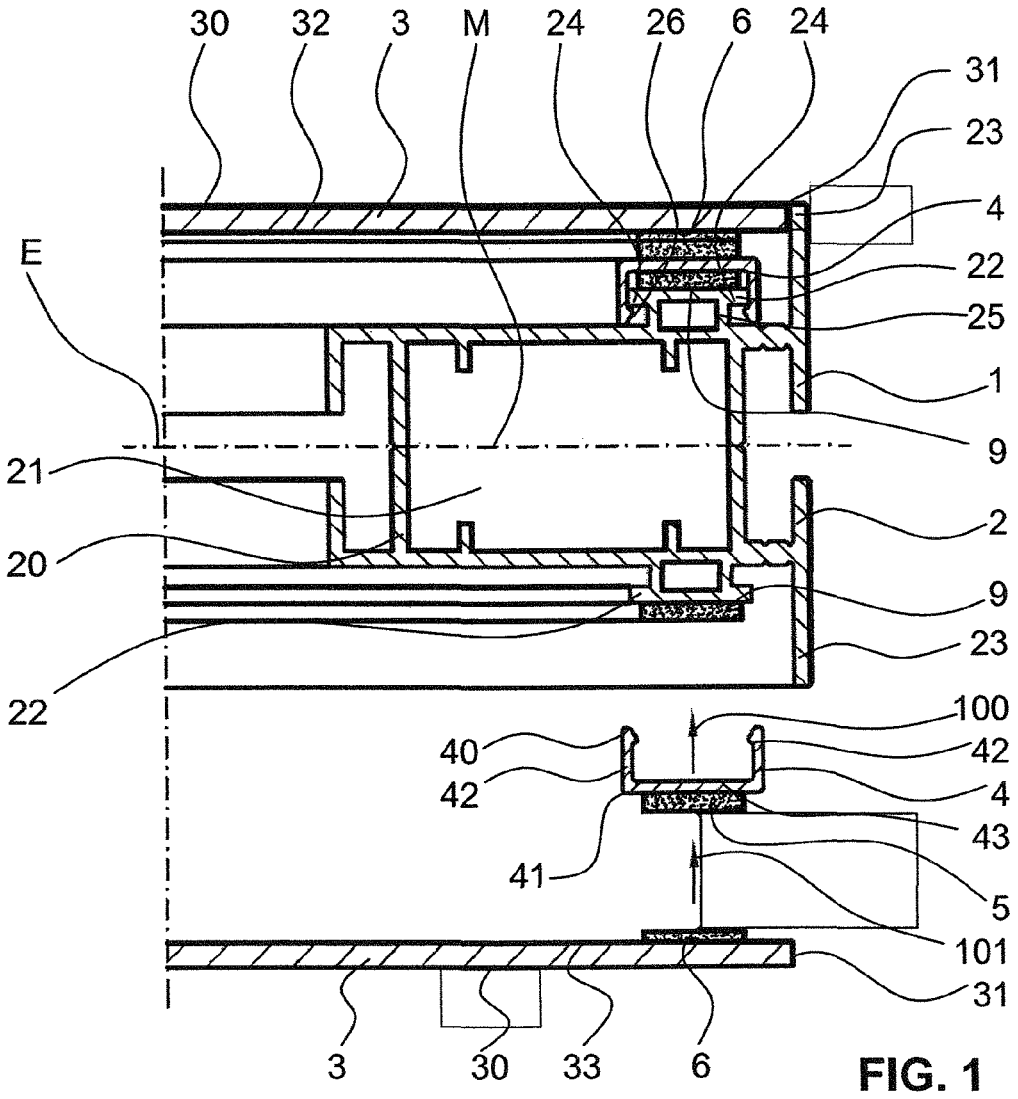
FIG. 1 shows a cross-sectional representation of a part of a system which is used to provide a planar structure, such as a wall or a ceiling, according to a first embodiment.

FIG. 1 shows a cross-sectional representation of a part of a system which is used to provide a planar structure, such as a wall or a ceiling, according to a first embodiment.

The system essentially comprises a profiled frame 1, which is assembled from a plurality of profiled elements 2, and a flat planar element 3 extending at least partially over this profiled frame 1, as well as a connecting element 4 which connects planar element 3 to profiled elements 2 and thus to profiled frame 1. Planar element 3 can be constituted rigid, i.e. self-supporting, and also flexible and essentially extends as a face in a plane. Connecting element 3 can be connected detachably to profiled frame 1 or to profiled elements 2 by means of a form-fit and/or force-fit closure. Connecting element 4 can be removed if necessary by means of this detachable connection, which is advantageous for the modularity of the system, since the profiled elements can then be used in different ways. Planar element 3 is in turn connected to connecting element 4 and is, as shown in FIG. 1, disposed between profiled element 2 and planar element 3. Consequently, the connection between profiled element 2 and planar element 3 is produced by connecting element 4.

Profiled frame 1 is essentially constituted in such a way that the latter comprises at least two profiled elements 2 lying opposite one another. Usually, however, profiled frame 1 is constituted in such a way that the latter provides a peripheral structure. Profiled elements 2 extend along a longitudinal axis M, which usually represents a straight line or can also be constituted curved.

According to the embodiment of FIG. 1, profiled element 2 has a symmetrical embodiment with respect to a plane E, which runs parallel to the front surface 30 of planar element 3. Viewed in cross-section, profiled element 2 essentially comprises a rectangular main body 20, which encloses a hollow space 21, a locating section 22 projecting from this main body in the direction of planar element 3 and a leg 23 projecting outwards. All elements 20, 21, 22 and 23 essentially extend along longitudinal axis M. Since profiled element 2 is constituted symmetrical in the present embodiment, wherein plane of symmetry E runs through hollow space 21, two locating sections 22 and two legs 23 are disposed here. If a planar element 3 is disposed on both sides of profiled frame s, a wall can be made available with a corresponding thickness which is defined by the spacing of planar elements 3. It is however also possible to dispose a planar element 2 only on one side of profiled frame 2.

Locating sections 22, viewed in cross-section, have a T-shaped form, two leg sections 24 projecting laterally from a main section 25, which is formed on main body 20, so that the two leg sections 24 border an undercut 26, into which connecting element 4 can hook according to the following description.

At this point, it should be noted that the embodiment of profiled element 2 can be arbitrary. With regard to the connection with connecting element 4, however, it is essential that corresponding elements are provided by means of which a force-fit and/or form-fit connection with connecting element 4 can be provided.

In connection with projecting leg 23, it should be noted that the latter essentially provides the lateral boundary of the system. Consequently, planar element 3 preferably has a size such that its overall dimensions extend up to respective leg 23. Depending on the size of leg 23 and the position of planar element 3, the latter is disposed with its front surface 30 flush or offset with respect to leg 23.

Connecting element 4 also extends along a longitudinal axis and, in the present embodiment, comprises a first connecting section 40 and a second connecting section 41. First connecting section 40 has here the form of two snap-in elements 42, which project perpendicularly from body 43 and enter into a snap-in connection with locating section 22 of the profiled element. Second connecting section 40 is provided by a textile closure element 5, which is disposed on the surface of base body 43 lying opposite snap-in elements 42. Textile closure element 5 essential has the form of a textile strip, which is glued onto base body 43.

In the embodiment shown in FIG. 1, planar element 3 also comprises a textile closure element 6, which is disposed peripherally, and spaced apart from edge 31, on rear surface 32 on planar element 3. Textile closure element 6 on planar element 3 can enter into a detachable connection with textile closure element 5 of connecting element 4. Textile strips 5, 6 are preferably provided by a VELCRO® (a fabric hook and loop fastener) closure or a VELCRO® tape.

Connecting element 4 can, as shown in FIG. 1, be snapped in along a first movement 100 onto locating section 22 of profiled element 2. The arrangement of planar element 3, which is connected to connecting element 4 by means of textile strips 5, 6, then follows, which is represented by arrow 101.

In FIG. 1, planar element 3 is represented as a rigid planar element 3. It is however also conceivable for this planar element to the embodied as a flexible planar element, wherein textile closure elements 5, 6 then have to take up a shearing force due to the tension in flexible planar element 3. This is however readily possible by adapting the width of textile closure elements 5, 6.

With regard to FIG. 1, it should be noted that each planar element 3 can be disposed on profiled frame 1 on both sides or also only on one side. The two-sided arrangement is shown in FIG. 1, it being possible here for example to dispense with planar element 3 represented before the assembly.

A further optional textile closure element 9 is shown between connecting 4 and locating section 22. This closure element 9 is used when it is intended to dispense with connecting element 4. Planar element 3 can then be disposed directly on closure element 9.

Figure 2:
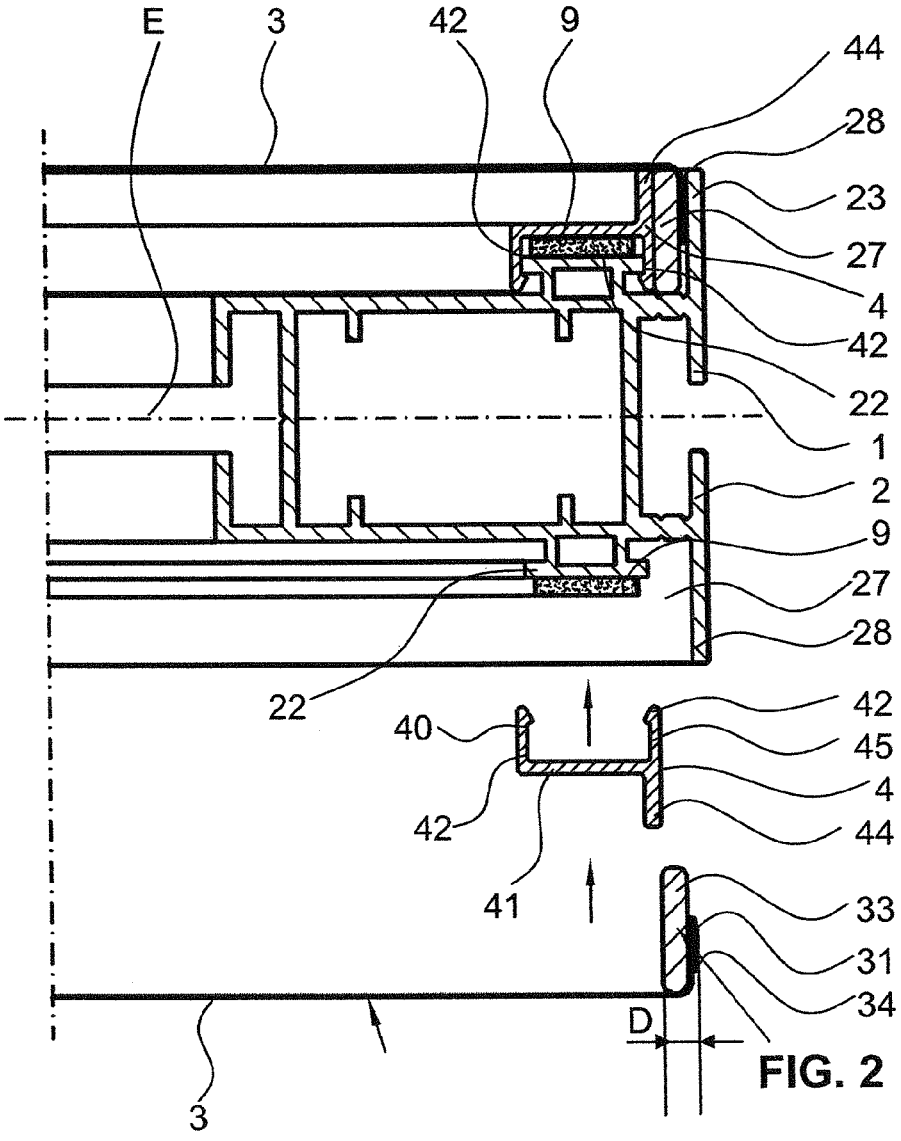
FIG. 2 shows a cross-sectional representation of a part of a system which is used to provide a planar structure, such as a wall or a ceiling, according to a second embodiment.

FIG. 2 shows a cross-sectional representation of a part of a system which is used to provide a planar structure, such as a wall or a ceiling, according to a second embodiment. In the second embodiment, use is essentially made of profiled element 2 of the first embodiment, another profiled element also being able to be used. Identical parts are provided with the same reference numbers.

The second embodiment is essentially used for clamping a planar element 3 with a flexible embodiment, i.e. for example a fabric structure or a film structure. For this purpose, connecting element 4 comprises a web 44, which projects from base body 43 and which is disposed essentially in alignment with opposite-lying snap-in body 42. Web 44 and corresponding snap-in body 42 provide a surface 45. Together with surface 28 of projecting leg 23, snap-in body 42 and web 44 or surface 45 form an intermediate space 27.

Intermediate space 27 is used to accommodate edge region 33 of planar element 3, wherein the latter is clamped in a force-fit manner in intermediate space 27, so that planar element 3 can be clamped over profiled frame 1. Consequently, first connecting section 40 has the same form as in the first embodiment and second connecting section 41 is formed by web 44 and intermediate space 27. Intermediate space 27 extends along profiled element 2 and essentially runs over its entire length.

Planar element 3 preferably comprises in edge region 33 an edge reinforcement element 34, such as a peripheral strip or beading 34, which gives edge region 33 a certain thickness and stability. Beading 34 is produced from a soft and springy material, which after compression strives to reassume its original shape. Thickness D of the parts which project into intermediate space 27 is preferably greater in the original state than the inside width of intermediate space 27. Thickness D is defined here by the corresponding dimension of beading 34 and of the planar element. This ratio has the effect that, in particular, beading 34 is compressed during the assembly and then, in the state inserted into intermediate space 27, is clamped in intermediate space 27 in that it strives to assume the original the position. Alternatively, the thickness of beading 34 can also be selected equal to the inside width of intermediate space 27.

Edge reinforcement element 34 preferably has a width such that it extends over the entire depth of intermediate space 27. Edge reinforcement element 34 can be disposed in such a way that it extends over actual edge 31 of planar element 3.

Beading or strip 34 is preferably connected to planar element 3 by means of an adhesive joint and/or by means of a weld joint. Beading 34 preferably has a rectangular cross-section, wherein the corners can be constituted rounded-off, so that easier introduction into intermediate space 27 is enabled. The beading is preferably produced from a plastic strip.

In the second embodiment, connecting element 4 is assembled in a first step, so that intermediate space 27 is created. Planar element 3 is then clamped in the intermediate space.

The relative position of planar element 3 with respect to projecting leg 23 can be adjusted via the length difference between web 44 and projecting leg 23. It is possible to select web 44 somewhat shorter or longer, so that planar element 3 with surface 30 is not flush with leg 23, or to select the same length, so that the flush state can be produced.

Alternatively, web 44 can also be dispensed with, wherein intermediate space 27 is then provided by corresponding snap-in element 42 and leg 23.

With regard to connecting elements 4, it can also be stated in this regard that the latter preferably extend in all the embodiments over the same length as profiled element 2, to which connecting element 4 is connected.

Figure 3:
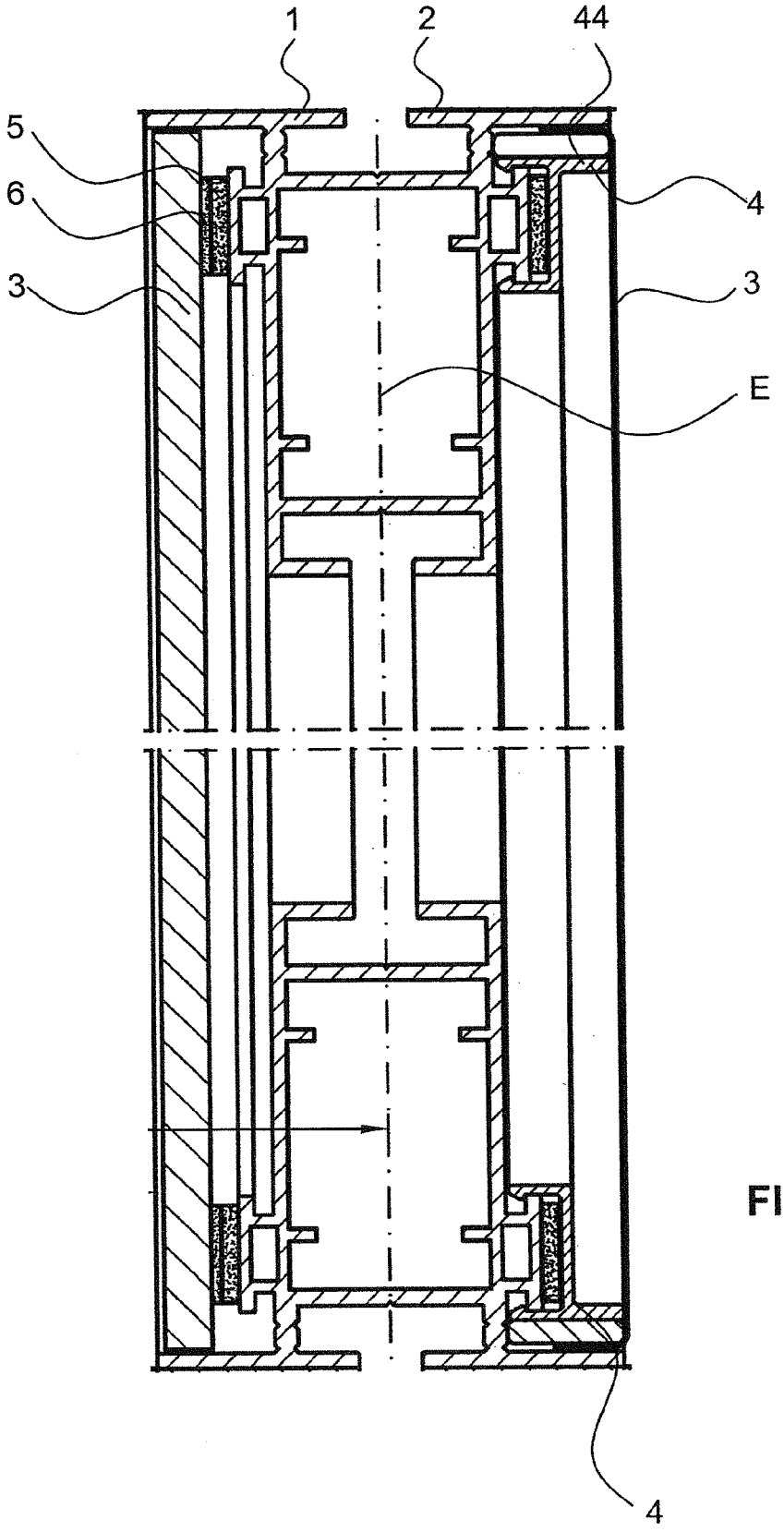
FIG. 3 shows a cross-sectional representation of the system according to FIG. 2.

FIG. 3 shows a combined application of the first embodiment and the second embodiment on the same profile, wherein it is intended to show the modularity by way of example. Planar element 3 disposed on the left-hand side accordingly comprises a rigid structure, whereas planar element 3 disposed on the right-hand side shows a flexible structure.

Planar element 3 disposed on the left is connected here to the profiled frame by means of a textile closure element 5, which is disposed directly on profiled element 2. The use of a connecting element 4 according to the first embodiment would however also be conceivable.

Planar element 3 disposed on the right is connected to profiled element 2 or profiled frame 1 by means of connecting element 4 according to the second embodiment.

Figure 4:
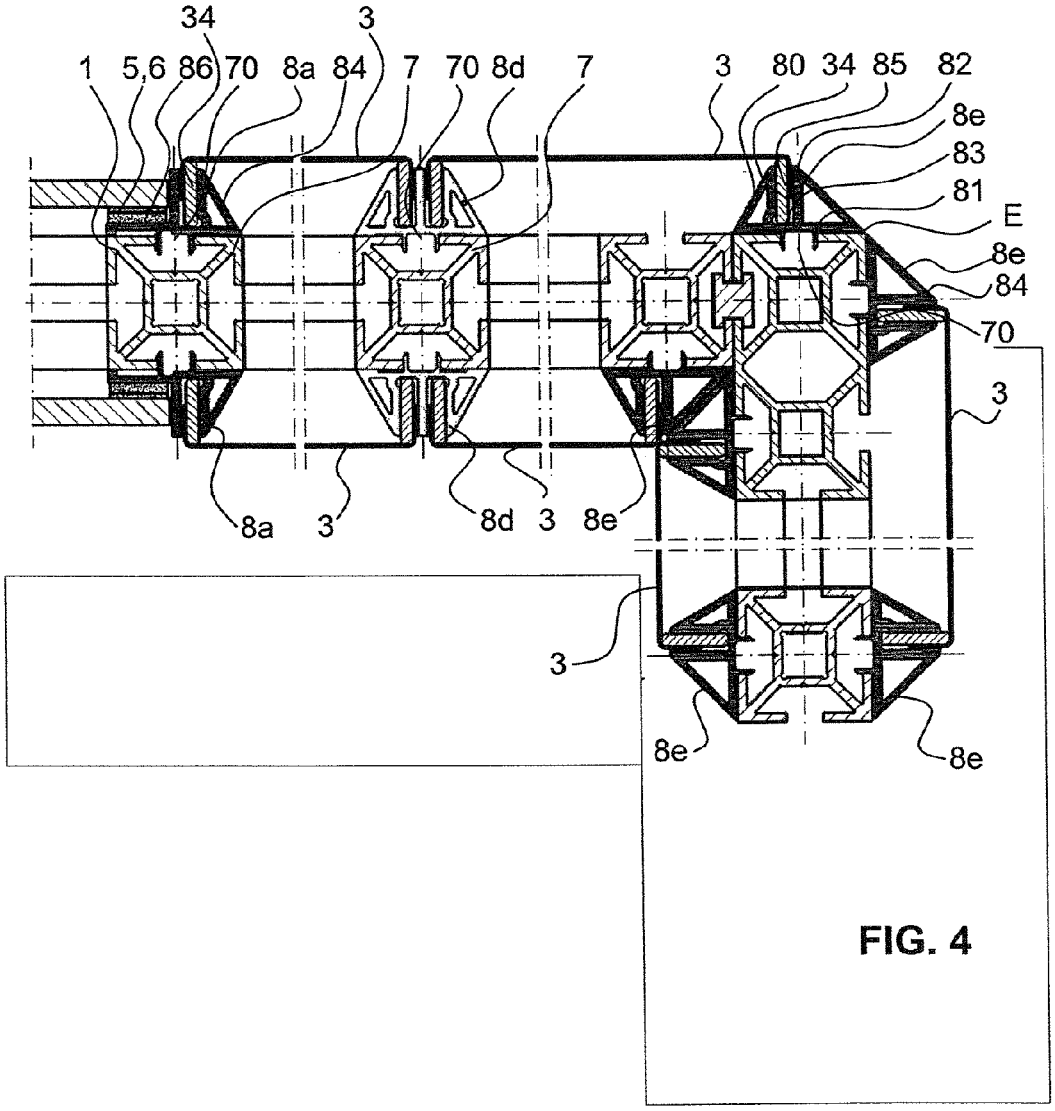
FIG. 4 shows a cross-sectional representation of a part of a system according to a third embodiment.
Figure 5:
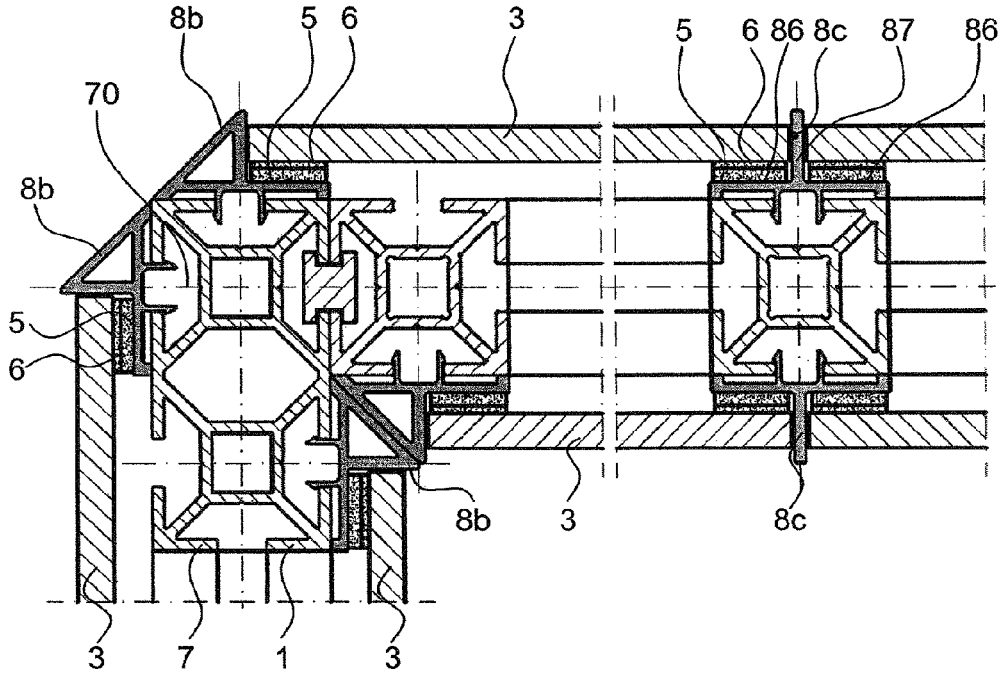
FIG. 5 shows further cross-sectional representations of a part of a system according to further embodiments.

FIGS. 4 and 5 show a further embodiment, wherein both rigid and flexible planar elements 3 can be used. Identical parts are again provided with the same reference numbers.

FIG. 4 essentially shows examples of embodiment with flexible planar elements 3. Profiled frame 1 is assembled here from profiled elements 7, which essentially have a square or rectangular cross-section. Profiled elements 7 essentially comprise here, per surface, at least one groove 70, into which a connecting element 8 can be inserted or can be connected to groove 70. The connecting elements are provided with reference numbers 8*a* to 8*e* and corresponding to respective FIGS. 6*a* to 6*e*.

Connecting element 8 extends essentially in the same direction as profiled element 7 and can be constituted differently in cross-section according to FIGS. 6*a* to 6*e*.

Connecting elements 8, i.e. 8*a* to 8*e*, comprise here a base body 80 with a first connecting section 81, which is formed for the connection to profiled element 7, and a second connecting section 82 making contact with planar element 3.

First connecting section 81 is constituted here by snap-in elements 83. Snap-in elements 83 are constituted such that the latter can be snapped into groove 70 and can thus be connected to profiled element 7.

Second connecting section 82 can be constituted in different ways, so that flexible planar element 3 and/or rigid planar element 3 can be clamped or fixed to connecting section 82.

Furthermore, connecting section 82 can comprise a face 84 which is disposed at an angle and which can be used as a profile cover face. This can be seen particularly well in FIG. 4, wherein a connecting element 8 is disposed in each case here at corner E of profiled frame 1 on the adjacent faces of profiled element 7 that are pointing outwards, face 84 of said connecting element forming a terminal face lying at an angle to planar element 3. The angle between face 84 and planar element 3 is preferably 45°.

Face 84 of a first connecting element can also come into contact with that of a second one, if the connecting element is disposed in an inner corner of a profiled frame.

It can also clearly be seen in FIG. 4 that second connecting section 82 can be provided with an intermediate space 85, wherein the intermediate space 85 essentially has the function of intermediate space according to the previous embodiment, i.e. the clamping of flexible planar element 3 with reinforcement element 34. With regard to the function, intermediate space 85 has the same properties as intermediate space 27.

It is also possible to dispose two intermediate spaces running parallel to one another on a single connecting element 8*d*.

The profile cross-sections of connecting elements 8 will be explained in greater detail with the aid of FIGS. 6*a* to 6*e* and FIGS. 4 and 5. All connecting elements 8*a* to 8*e* have an identical base body and an identical first connecting section 81.

FIG. 6*a* shows connecting elements 8*a*, which can also be seen in FIG. 4. Connecting elements 8*a* extends along a longitudinal direction L as a profile and comprises here base body 80, from which two snap-in elements 83 extend as a first connecting section 81. Opposite first connecting section 81, connecting element 8*a* comprises second connecting section 82, which essentially comprises here an intermediate space 85, as well as a contact face 86 disposed beside this intermediate space 85. Intermediate space 85 serves to accommodate planar element 3 with edge reinforcement element 34. A textile connecting element 5 can be disposed on contact face 86, said connecting element producing a connection with a textile connecting elements 6 of planar element 3. On the side lying opposite with respect to intermediate space 85 viewed from contact face 86, connecting element 8*a* also comprises an angular face 84, which can be used as a cover element, as described above. This connecting element 8*a* is particularly advantageous, since both a flexible planar element and a rigid planar element can be connected to the profiled frame, which permits the creation of an aesthetic structure.

Figure 8A:
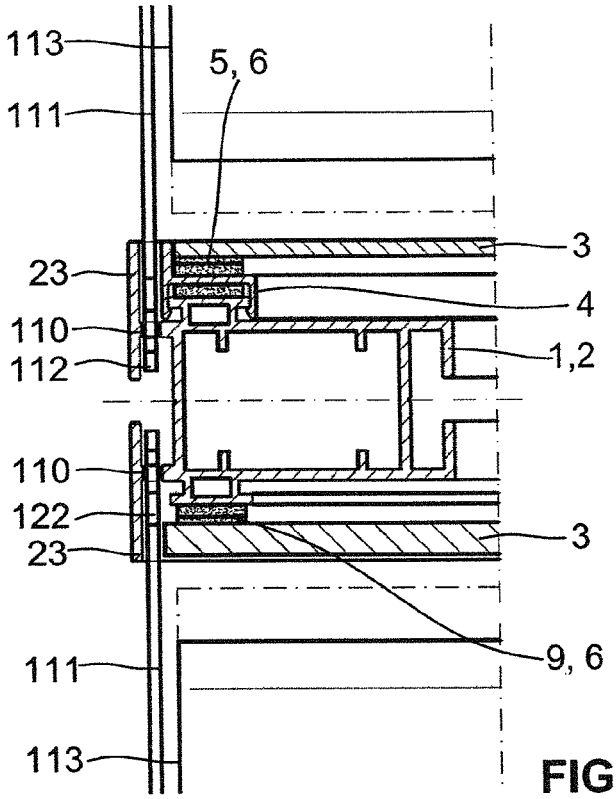
FIG. 8*a*, 8*b* show a further embodiment of the system, wherein the system is provided here with shelves.

FIG. 6*b* shows a further embodiment of a connecting element 8, i.e. connecting element 8*b*. Connecting element 8*b* is constituted essentially identical to connecting element 8*a*, but does not comprise intermediate space 85, but only contact face 86 for accommodating textile closure element 5, 6 and angular face 84. Such a connecting element 8*b* is used in the provision of a connection between a rigid planar element 3 and framed profile 7, as is shown in FIG. 8*a*.

FIG. 6*c* shows a further embodiment of a connecting element 8, i.e. connecting element 8*c*. Connecting element 8*c* comprises the same first connecting section 81 as the two aforementioned connecting elements 8*a* and 8*b*. Second connecting section 82 here essentially comprises two contact faces 86, which are separated by a web 87 extending in longitudinal direction L. Textile strip 5 can again be disposed on the two contact faces 86 running parallel to one another, said textile strip then being able to be connected to textile strip 6 of rigid planar element 3.

FIG. 6*d* shows a further embodiment of a connecting element 8, i.e. connecting element 8*d*. Second connecting section 82 here has the form of two intermediate spaces 85 disposed parallel to one another. To the side of intermediate spaces 85, second connecting section 82 also comprises two angular faces 84.

FIG. 6*e* shows a further embodiment of a connecting element 8, i.e. connecting element 8*e*. Connecting element 8*e* comprises an intermediate space 85 and two angular faces 84, wherein the angle with respect to base body 80 in the case of face 84 disposed on the left here is flatter than in the case of face 84 disposed on the right.

Connecting elements 8*a* to 8*e* are preferably extruded from a plastic and can be cut to the desired length by the user.

Figure 7:
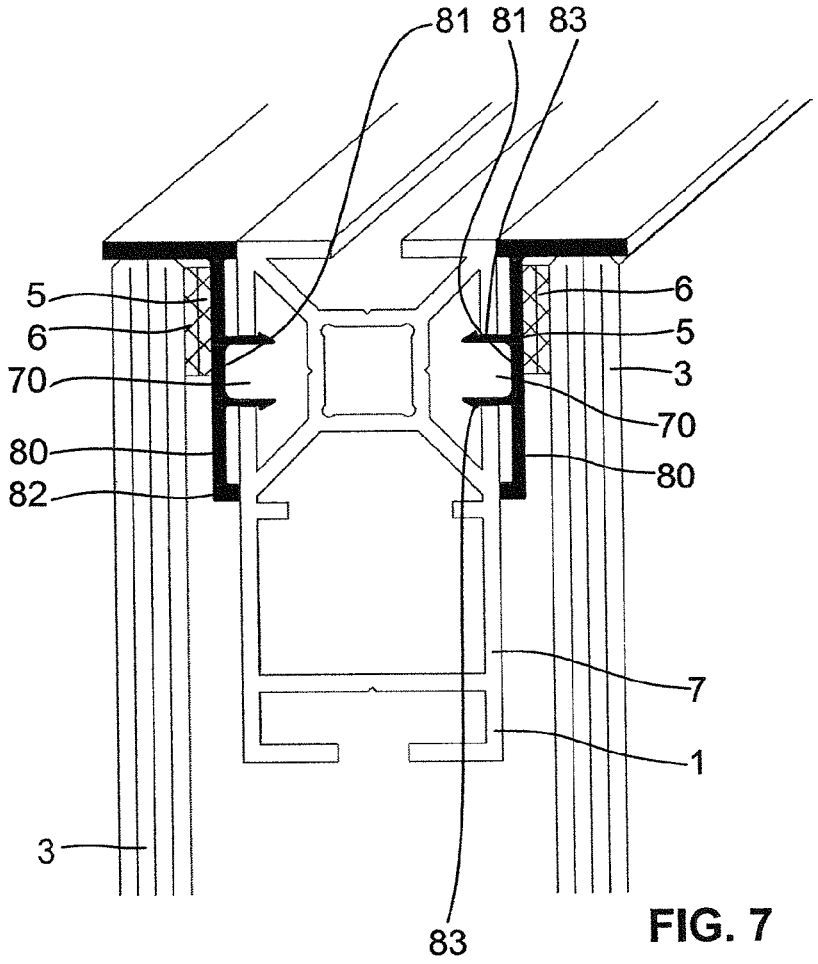
FIG. 7 shows a further embodiment of the system in a side view.

FIG. 7 shows a further embodiment of a system used to provide a planar structure. Identical parts are again provided with the same reference numbers. Here, connecting element 8 also comprises a base body 80 with a first connecting section 81 and a second connecting section 82. Disposed on first connecting section 81 are two snap-in elements 83, which extend into a groove 70 of profiled element 7. The second connecting section essentially comprises a face 84, from which a web 87 projects perpendicularly. Web 87 serves as an outer border of planar element 3. Planar element 3 is connected to connecting element 8 by means of textile connecting elements 5, 6, which are disposed, in particular glued, on surface 30 or on face 84.

Figure 8B:
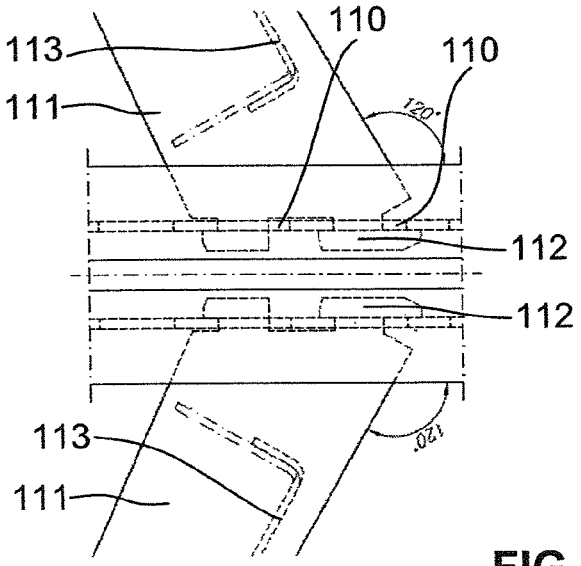

FIGS. 8*a* and 8*b* shows a further embodiment of a system used to provide a planar structure. Identical parts are again provided with the same reference numbers. As an additional to the embodiments shown in FIGS. 1 to 3, this embodiment comprises fixing elements 110, which are used to accommodate fixing sections 112 of shelf supports 111, which can be connected to shelves 113.

FIG. 8*a* shows the system in a cross-sectional representation. It can clearly be seen that, in the region of web 23, punch-outs are provided which serve as fixing elements 110 for shelf supports 111.

FIG. 8*b* shows FIG. 8*a* from the side, wherein the form of punch-out 110 can clearly be seen. The punch-out is constituted here has an oblong slot 110, wherein two adjacent slots 110 can in each case accommodate two fixing elements 110 of a shelf support 111.

| LIST OF REFERENCE NUMBERS | |
|---|---|
| 1 | profiled frame |
| 2 | profiled element |
| 3 | planar element |
| 4 | connecting element |
| 5 | textile closure element |
| 6 | textile closure element |
| 7 | profiled element |
| 8 | connecting element |
| 9 | further connecting element |
| 20 | main body |
| 21 | hollow space |
| 22 | locating section |
| 23 | projecting leg |
| 24 | leg section |
| 25 | main section |
| 26 | undercut |
| 27 | intermediate space |
| 28 | surface |
| 30 | front surface |
| 31 | edge |
| 32 | rear surface |
| 33 | |
| 34 | edge reinforcement element |
| 40 | first connecting section |
| 41 | second connecting section |
| 42 | snap-in elements |
| 43 | base body |
| 44 | Web |

-continued

| LIST OF REFERENCE NUMBERS | |
|---|---|
| 45 | Surface |
| 70 | Groove |
| 80 | base body |
| 81 | first connecting section |
| 82 | second connecting section |
| 83 | snap-in elements |
| 84 | Face |
| 85 | intermediate space |
| 86 | contact face |
| 87 | Web |
| 100 | first movement |
| 101 | second movement |
| 110 | fixing elements |
| 111 | shelf carrier |
| 112 | hook-in sections |
| 113 | Shelf |
| D | thickness |

The invention claimed is:

1. A system for providing a planar structure to serve as a wall or a ceiling, comprising:

a profiled frame assembled from a plurality of profiled elements and a flexible flat planar element extending at least partially over said profiled frame, wherein the planar element is connected detachably to a connecting element in a form-fit and/or force-fit closure, wherein the connecting element is detachably connected to the profiled frame by means of a form-fit and/or force-fit closure, so that the planar element is indirectly connected to the profiled frame by means of the connecting element, wherein the connecting element is separate from the profiled frame and the planar element, wherein the planar element has a flexible structure with an edge region, wherein the profiled element and the connecting element provide an intermediate space which accommodates the edge region of the flexible structure in an essentially force-fit manner, the entire flexible structure is at least one of a fabric structure and a film structure, wherein the flexible structure extends into said intermediate space, wherein the flexible structure comprises an edge reinforcement element at the edge region, wherein a thickness of the planar element and of the edge reinforcement element is greater than an inside width of the intermediate space before compression, and wherein the intermediate space is provided by a surface of a leg extending from the profiled element essentially perpendicular to a surface of the planar element and by a surface of the connecting element facing the leg.

2. The system according to claim 1, wherein the connecting element is connected to the profiled frame by means of a snap-in connection, wherein the connecting element comprises snap-in elements which extend from the connecting element from a side facing the profiled frame.

3. The system according to claim 2, wherein the snap-in elements engage around a locating section projecting from the profiled element or engage in a groove disposed in the profiled element.

4. The system according to claim 1, wherein the connecting element essentially extends over a same length as the profiled element to which the connecting element is connected.

5. The system according to claim 1, wherein the connecting element comprises a first textile closure element on a side facing the planar element, and that the planar element comprises a second textile closure element adhering to the first textile closure element, so that the planar element can be connected to the connecting element by means of the textile closure elements.

6. The system according to claim 5, wherein the textile closure element has the form of a hook-and-loop fastener.

7. The system according to claim 1, wherein the planar element is surrounded at the edge completely or in sections around the periphery with the edge reinforcement element, wherein the edge reinforcement element can be introduced into the intermediate space and can be clamped there in a force-fit manner.

8. The system according to claim 1, wherein a web extends from the connecting element from a side facing the planar element, so that the corresponding surface is enlarged.

9. The system according to claim 1, wherein the intermediate space is formed on the connecting element.

10. The system according to claim 9, wherein the connecting element comprises a face extending in a direction of a longitudinal axis of the connecting element.

11. The system according to claim 9, wherein the connecting element comprises at least one contact face, which essentially runs parallel to a surface of the planar element and serves to accommodate a textile connecting element, so that a planar element provided with a corresponding textile connecting element can be connected to the connecting element.

* * * * *